US006073867A

United States Patent [19]

Ferlež

[11] Patent Number: 6,073,867

[45] Date of Patent: Jun. 13, 2000

[54] VERSATILE MILL

[76] Inventor: Karel Ferlež, Cesta VIII/1, 63320 Velenje, Slovenia

[21] Appl. No.: 08/809,599

[22] PCT Filed: Oct. 5, 1995

[86] PCT No.: PCT/SI95/00025

§ 371 Date: Jun. 6, 1997

§ 102(e) Date: Jun. 6, 1997

[87] PCT Pub. No.: WO96/11058

PCT Pub. Date: Apr. 18, 1996

[30] Foreign Application Priority Data

Oct. 7, 1994 [SI] Slovenia ..... P-9400384

[51] Int. Cl.[7] ..... B02C 18/08; B02C 18/18

[52] U.S. Cl. ..... 241/56; 241/65; 241/162; 241/282.2

[58] Field of Search ..... 241/56, 65, 162, 241/199.12, 282.2, 292.1

[56] References Cited

U.S. PATENT DOCUMENTS

| | | | |
|---|---|---|---|
| 2,894,551 | 7/1959 | Otto | 241/199.12 X |
| 3,139,917 | 7/1964 | Elmore | 241/199.12 X |
| 4,747,550 | 5/1988 | Jackering | 241/55 |
| 5,085,375 | 2/1992 | Haworth | 241/55 |
| 5,542,615 | 8/1996 | Yu et al. | 241/57 |
| 5,634,600 | 6/1997 | Kubota et al. | 241/36 |
| 5,695,130 | 12/1997 | Csendes | 241/19 |

FOREIGN PATENT DOCUMENTS 26 58 974 7/1978 Germany .

514356 12/1971 Switzerland .

*Primary Examiner*—John M. Husar
*Attorney, Agent, or Firm*—Robert P. Bell

[57] ABSTRACT

The invention concerns a versatile mill, particularly the construction of its drive, central and clamping part with the fitting of knives, and the cooling of the milling part. The versatile mill is intended for processing food products and other organic and inorganic substances in the sense of milling, chopping, grinding, mixing or disintegrating the parts inserted into it in an enclosed processing system. A versatile mill in accordance with the invention has its driving motor (M) mounted in the same plane with the milling part (D) of the mill, an improved system of clamping knives (3) on a shaft (1), which is profiled, while the positioning of the knives (3) itself is carried out by means of intermediate discs (2); on the lower part under the bottom (11) of the milling part (D) a plate (7) is fitted which is rigidly linked with the shaft (1) and rotates together with it; in an air inlet (8) on the shaft (1) a fan (9) is fixed, while the bottom (11) of the mill and the stationary lateral parts of the milling compartment are carried out with double walls, whereby on the upper part of the milling compartment there is a collector which directs, along one path, the air inside the enclosed system, or—when the return channels are removed—the air in the open system into the center of the mill. Along another path, it directs the atmospheric air at the end of the cooling system—in the case of an enclosed system—to the return channels with the purpose of cooling them; two lateral output parts (A), (B) have their outer walls in the shape of two cones facing each other and ending at each side and on one end into output openings.

23 Claims, 5 Drawing Sheets

VERSATILE MILL

FIELD OF THE INVENTION

The invention concerns a versatile mill, with particular accent on the construction of its drive, central and clamping part with the fitting of knives and cooling of the milling section. The versatile mill is intended for processing food products and other materials in the sense of milling, chopping, grinding, mixing or disintegrating the materials inserted in it, in an enclosed processing system. The invention belongs to IPC class B 02 C 18/18 or 02 C 23/32.

BACKGROUND OF THE INVENTION

The technical problem that is successfully solved by the present construction of a versatile mill is to achieve such constructional solutions on the device that will eliminate the deficiencies of known implementations, especially as regards simple transportation, rapid and simple exchange of knives and successful cooling of the milling compartment, so that a continuous working process as well as all kinds of operations will be made possible.

Milling devices that operate according to various principles have been in use. Since the present application describes a versatile mill operating according to the principle of material processing by means of grinding, chopping, or cutting—depending on the type of the rotating knives used—our description will be restricted to this type of devices.

Versions of mills with rotating knives are known which have the knives positioned one above the other on a vertical and profiled shaft, and the mutual position of the knives as well as the distance between them can be adjusted according to the type of processing. Such is, for example, the basic design of a mill described in the Yugoslav patent documents no. 26030 and 30648. In this design each knife is fitted with a centrically made rectangular opening intended for positioning individual knives between themselves, this opening having the same dimensions as the shaft. In this way individual knives can be shifted aside by an angle of 90°. The positioning of other angles between the knives can be realized by a multi-angular shaft with the knives having the corresponding openings, or by knives which are expressly fitted with openings shifted by a certain angle in order to be pushed onto the shaft. A drawback of such positioning is that at a sudden stop of the knife, e.g. due to a foreign object in the material to be milled, both the knife and the shaft may get damaged, and it will be hard or even impossible to remove a knife thus damaged from the shaft. Another drawback lies in the fact that individual knives are predetermined for a definite position, which considerably limits the possibilities of combination.

Because of the installation of the driving motor under the milling compartment, the milling part and thereby the milled material receive excessive heating. Particularly in an enclosed milling system, when operating for a longer time, the mill gets overheated. Therefore, it has to be stopped from time to time, also because the milled substance overheats. In addition, when the driving motor is installed under the bottom of the milling compartment, the driving motor shaft usually extends into the milling compartment. This may cause, due to the unfavourable length of the entire shaft, constructional difficulties and make it difficult to transport the mill because of its height.

SUMMARY OF THE INVENTION

The versatile mill in accordance with the invention has the driving motor installed in the same plane with the milling part, an improved clamping system for the knives on the shaft which is profiled, and the positioning of the knives is carried out by means of intermediate disks; on the tower part under the bottom of the milling compartment, a plate is installed which is rigidly linked with the shaft so that it turns together with it; under the bearing case, also on the shaft, a fan is fixed, while the bottom of the mill and the stationary flanks of the milling compartment are fitted with double walls; on the upper part of the milling compartment there is a collector which directs, in the one direction, the air of the enclosed system into the centre of the mill, and in the other direction, the atmospheric air at the end of the cooling system to return channels. With the removal of the return channels, an open milling system is obtained through which fresh air is admitted into the mill and out of it at the flanks (when tough materials producing excessive heat are milled). The lateral outlet parts have their outer walls on the shape of two cones facing each other, ending at one end on either side with an outlet opening.

BRIEF DESCRIPTION OF THE DRAWINGS

The invention will be described by way of example and with reference to the accompanying drawings in which.

DETAILED DESCRIPTION OF THE INVENTION

Figure 1:
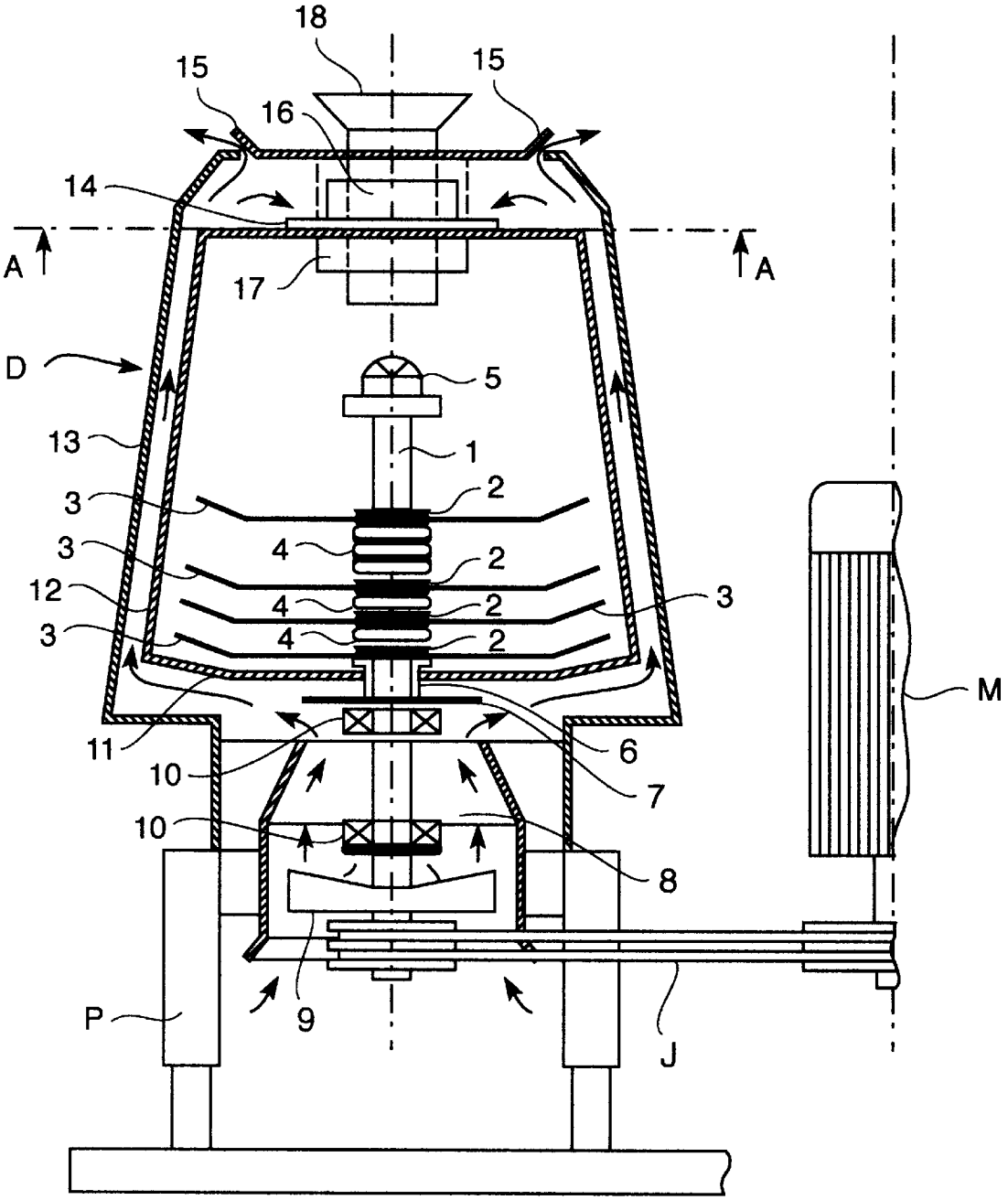
FIG. 1 is a side view illustrating a versatile mill in accordance with the invention in cross-section.
Figure 1A:
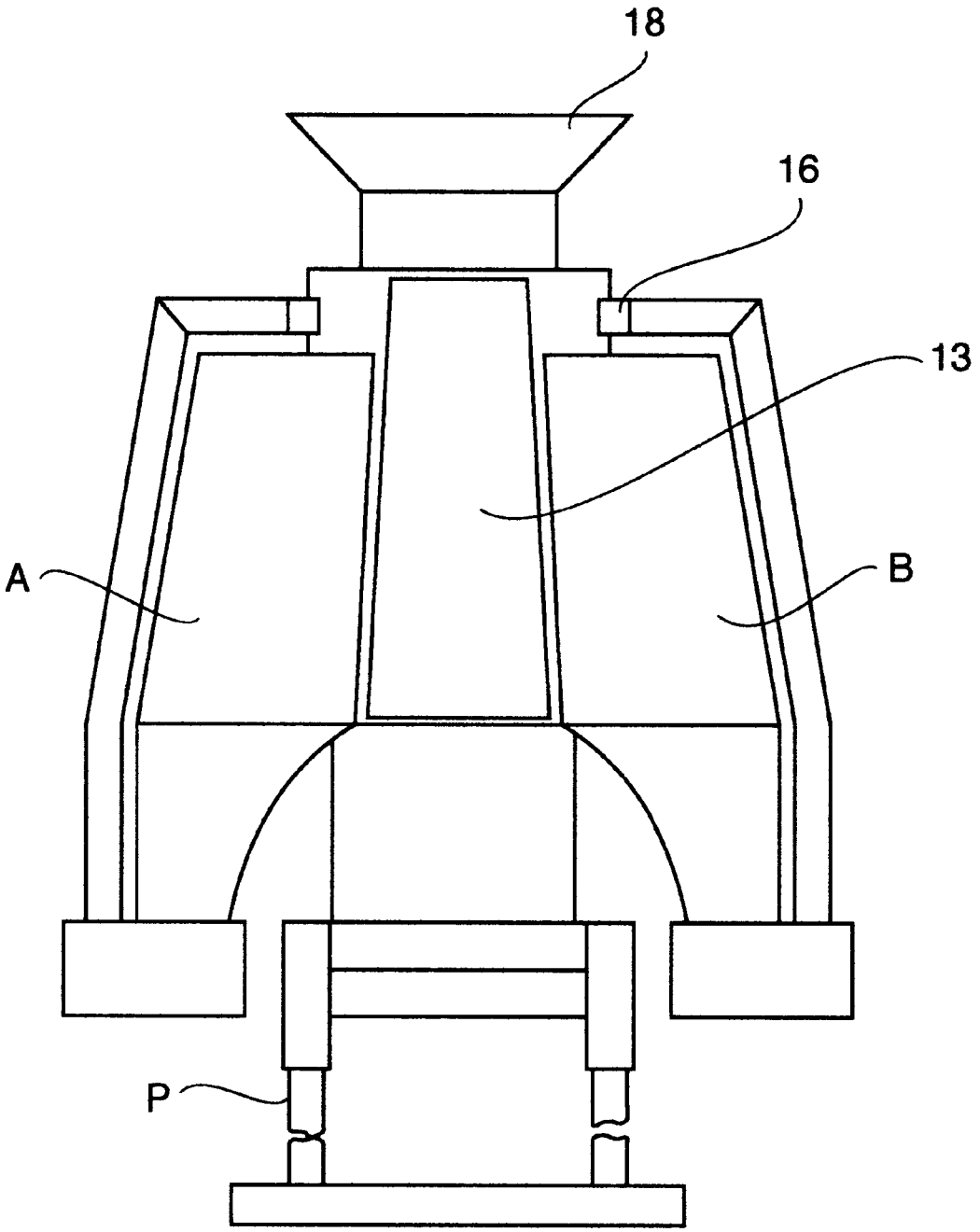
FIG. 1*a* is a front view of a versatile mill in accordance with the invention.

FIG. 1 is a side view of a versatile mill in accordance with the invention in cross-section. A constructional novelty as compared to known designs consists in the positioning of the driving motor M in the same plane with the milling part D of the mill and in linking them by means of a belt drive J. Such installation has several advantages. First, the overheating of the milling part D due to the heating of the driving motor M is omitted, which is a very important feature in a process of continuous operation; secondly, the above described positioning of the driving motor M and a telescopic support P make it possible to adjust the height of the support P and thereby of the entire versatile mill. Last but not least, such constructional solution makes it possible to dismantle the versatile mill in accordance with the invention into the support P, the driving motor M with the control box and the milling part D, which makes the versatile mill under invention extremely flexible, as it can easily be dismantled and reassembled on the site. Because of separate installation of the driving motor M, the main shaft—which in known constructional solutions runs through the driving motor M and further into the milling part D, where systems of knives are being fixed to it—is essentially shorter in the solution under invention and no longer prone to break at transport or when overloaded, In order to solve the sealing problem of bearings 10 on the shaft 1, onto which knives 3 are mounted, particularly as concerns the invasion of dust and water into the bearings 10 on the shaft 1, a disk 7 has been mounted on the lower part under the bottom 11 of the milling part, the disk 7 being rigidly linked with the shaft 1 and turning together with it.

Figure 2:
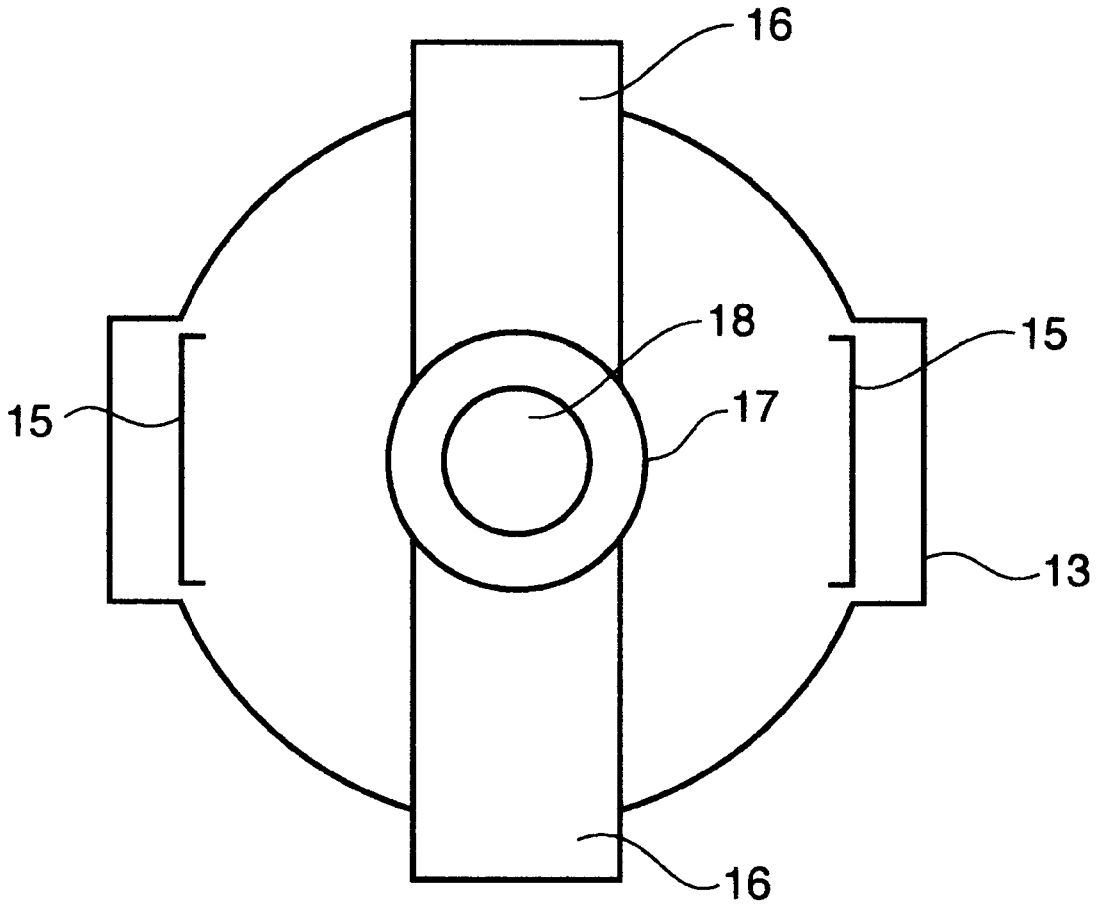
FIG. 2 is an A—A view of a versatile mill.

All particles that may make their way under the bottom 11 of the milling compartment D and fall on the disk 7, will be carried away by the centrifugal force. In an air inlet 8 a fan 9 is mounted on the shaft 1, and the air current produced by the fan 9 will carry the dust particles or particles of milled material through the cooling channels formed between the inner wall 12 and the outer coat 13 of the milling part D, and over cooling slits 14 and discharge outlet slits 15 into the atmosphere. In this way the bearings 10 are protected through cooling with the fresh air that flows from the fan 9; the same air, as it continues its way, abundantly cools the bottom 11 of the milling compartment D, and while flowing through the cooling channels, also the inner walls of the milling part D of the versatile mill. The fresh air cools both the inner wall 12 of the milling part D and the return channels which through a recycled air inlet 16 complete the self-contained milling system, the cooling taking place in the collector which encompasses the discharge outlet slits 15, the recycled air inlet 16, separation annulus 17, and material inlet tube 18 (the collector shown in a cross-section view along line A—A in FIG. 2). Therefore the milling process can be continuous, and there is no need to stop the milling because of an overheating of the milling part D, or because of the milled material. It is important, however, that the combination of knives 3 should always provide a sufficient suction effect at the fresh air inlet through the recycled air inlet 16, even when the return channels are removed (an open milling system).

The ground material leaves the milling compartment 12 through both sides of the versatile mill in accordance with the invention. Depending on the type of milled material, sieves of various gradings may be installed at both flanks. Both sieves have the form of larger, slightly concavely shaped plates which are inserted between the lateral opening of the milling part and the lateral output parts of the mill. The lateral output parts A, B of the versatile mill in accordance with the invention are shaped so that the milled material—which is prone to sticking to the walls (e.g. coffee, sugar)—is automatically shedded out. To this purpose, both lateral output parts A and B have their outer walls in the shape of two cones facing each other, which end up on either side on one end into an output opening onto which sacks for milled material are fixed.

Figure 3:
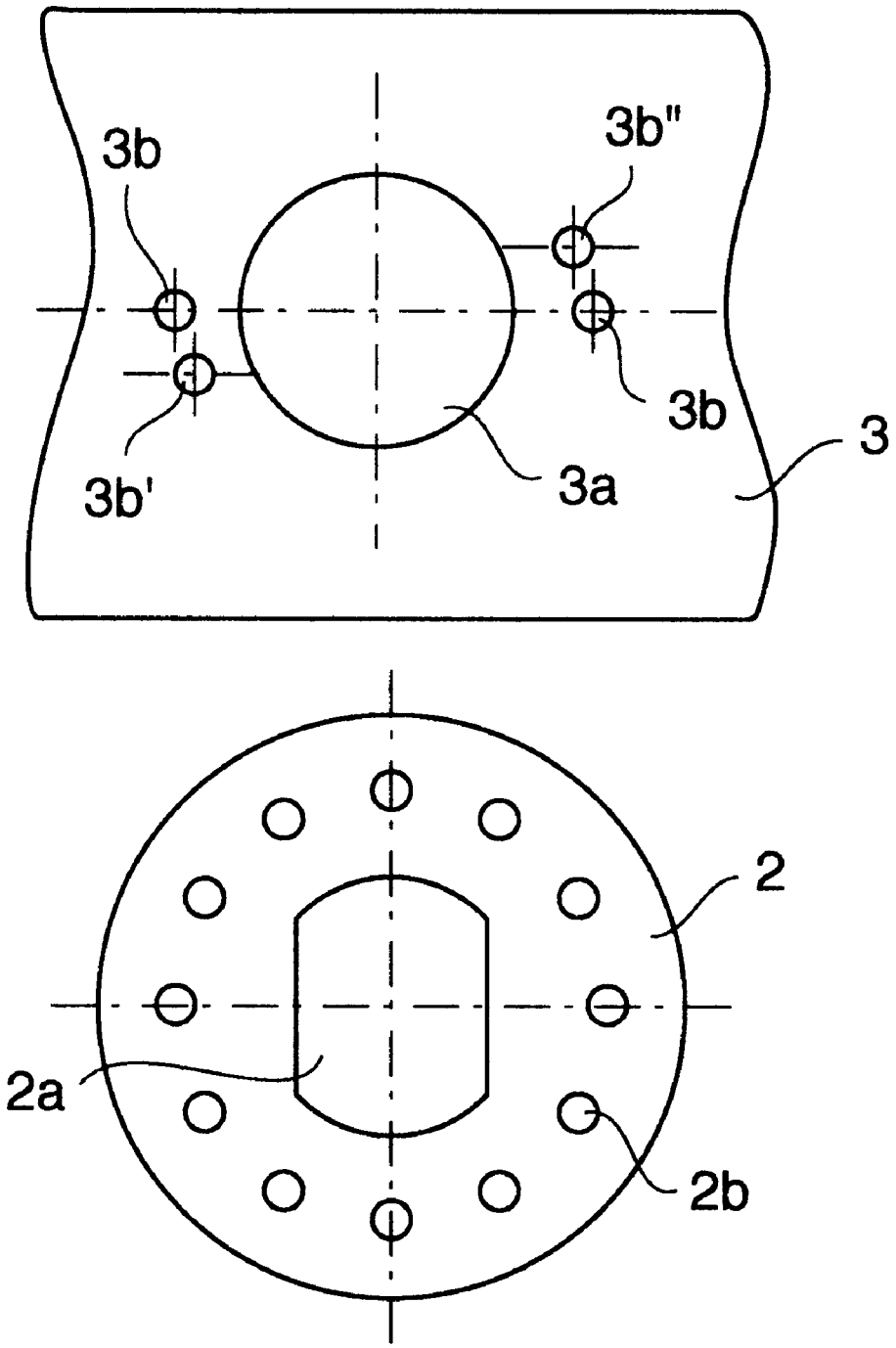
FIG. 3 is a top view of a knife 3 and an intermediate disk 2.

FIG. 3 illustrates the central part of a knife 3 and an intermediate disc 2 in a view from the top. The shape of knives 3, their fitting and position in relation to each other as well as the distance between individual knives 3 depend on the conditions of milling, cutting, grinding as such. The shaft 1 on which the knives 3 are fitted is profiled, and the positioning of the knives 3 is carried out by means of intermediate disks 2 having the opening 2*a* profiled to fit the profile of the shaft 1, while along the circumference it is fitted with small circular openings 2*b* (e.g. 12 openings, which make possible the positioning of individual knife 3 with regard to another knife 3 by an angle of 30°). Each knife 3 has a centrically made, circular opening 3*a*, and beside this, there are on either side two smaller openings 3*b*, which dimensionally and in terms of shape coincide with the openings 2*b* on the intermediate disk 2. To put individual knife 3 into proper position, it is necessary to match, by a safety element in the shape of a small cylinder of soft material, the opening 2*b* on the intermediate disc 2 with the opening 3*b* on the knife 3. After the entire combination of knives 3, intermediate discs 2 and washers 4 (these can be more than one between individual knives 3, as shown in FIG. 1) has been fitted, it is fixed on top by a nut 5. In this way the whole package is clamped between a sleeve 6 and the nut 5. The nut 5 can attain various shapes, the most suitable being the shape which enables the distribution of the material hitting the nut. IN particular, the milling of heavier material results in poor efficiency of first few rows of knives unless the material is forcefully distributed to the milling compartment 12 outer perimeter. The winged nut 5, shaped similar to an airplane propeller, is the preferred embodiment in the setting presented. Such fitting of knives 3 makes it very easy to put the knives into position, and in the event of a foreign body in the milling material, the safety element will break and the individual knife 3 will rotate freely. No damage to either the clamping part of the knife 3 or the shaft 1 will occur. The exchange of knives 3 and their arrangement into another combination is easy and does not require any special tools. The number of knives 3 fitted on the shaft 1 is optional and depends on the desired content of fine (dust, e.g. ground sugar) granulations in the product, or of such granulations that should contain no fine dust particles (e.g. filter tea).

Because of the possibility of fitting an optional number of knives 3 of various shapes, and with regard to the properties of the milled materials, and on account of the possibility of optional mutual positioning of the knives 3, numberless combinations or solutions can be preset. Additional smaller holes 3*b*', 3*b*" can be made in the knives 3, so that individual knives 3 may also be shifted by 15° or even a smaller angle.

Figure 4:
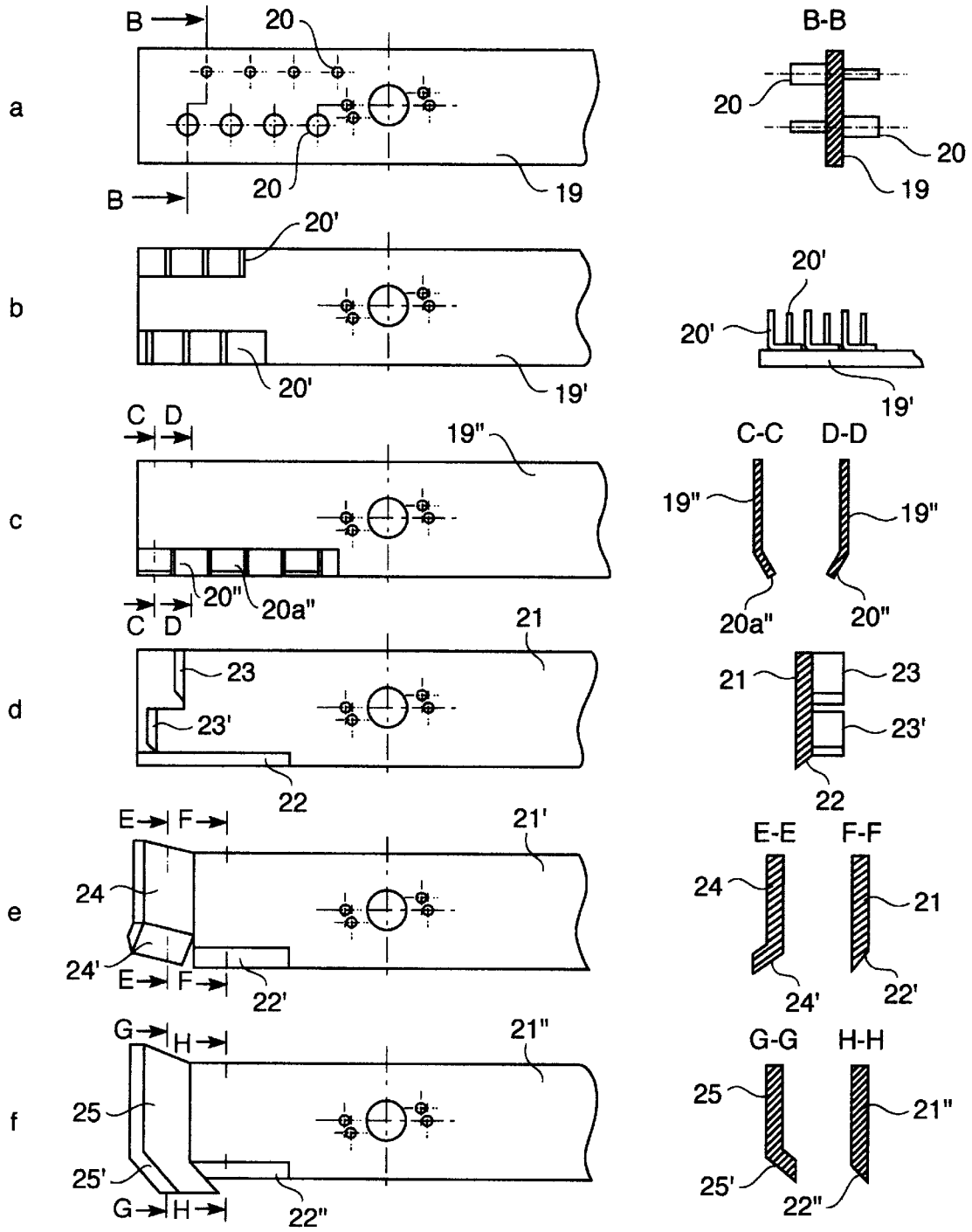
FIGS. 4*a*, 4*b*, 4*c*, 4*d*, 4*e*, 4*f* illustrate different shapes of knives.

In order to achieve special milling effects, the shapes shown in FIGS. 4*a* through 4*f* of the knives 3 can be used. Thus the knife in FIG. 4*a* has a flat body 19 and pins 20 positioned alternatively on both sides in two rows, each pin 20 consisting of two cylindrical parts of different thickness. The knife in FIG. 4*b* has a flat body 19' on which flat angular forms 20' of adjustable angle are fitted alternately on one side. The flat body 19" of the knife in FIG. 4*c* is fitted, on each front (striking) side, with beams 20" turned alternately up/down.

The knives 3 shown in FIGS. 4*a*, 4*b* and 4*c* in various mutual combinations are intended for processing materials which produce dust particles (e.g. flour, sugar, pepper, brick, etc.).

The shapes of knives shown in FIGS. 4*d* through 4*f*, fitted in various combinations, make it possible to cut or chop the material. For this purpose the fronts of the knives are sharpened on both sides. Thus the knife in FIG. 4*d* has a flat body 21 and an acute-angled front 22, while at different distances from the end, in the direction of rotation, on the upper side, two flat attachments 23, 23' are fitted with the sides ending up in acute angle in the direction of the knife's rotation.

The knife in FIG. 4*e* has a flat body 21' and an acute-angled front 22', where approximately in the middle of the front 22', an attachment 24 is bent more or less upwards with the front 24' lying in the same direction as the front 22' of the body 21'.

The knife in FIG. 4*f* has a flat body 21" and an acute-angled front 22", where an attachment 25 is bent more or less upwards approximately in the middle of the front 22", with its front 25' being turned in the opposite direction from the front 22' of the body 21".

All the above described knives 3, as well as the knives known from earlier descriptions and the knives (or tools) of other shapes, can be fitted on the shaft 1 at different mutual spacing, which is made possible by the insertion of intermediate disks 2. One or more than one spacer washers 4 may be inserted between individual knives, and the knives 3 may be shifted from each other by a certain angle either by means of holes 2*b* on the intermediate disks 2 and/or by means of additional holes 3*b*', 3*b*" in the knives 3. Thus through various combinations of different or identical knives 3, through their different mutual spacing and through their different mutual shifting, the shape of the milled material after treatment in the versatile mill under invention can be defined.

What is claimed is:

1. A versatile mill, comprising:

a driving motor;

a milling portion, linked to the driving motor by a belt drive; and a support, coupled to the driving motor and the milling portion, for allowing simultaneous telescopic adjustment of the height of the combination of the milling portion and the driving motor wherein the milling portion further comprises:

an inner wall;

an outer casing;

a channel formed between the inner wall and the outer casing and;

an air inlet connected to the channel;

a fan installed in the air inlet such that air flows from the air inlet, through the channel and past bearings on a milling shaft of the milling portion, a bottom portion of a milling compartment formed in the milling portion, inner walls of the milling compartment to cooling slits and to a collector with discharge outlet slits, wherein said versatile mill further comprises:

a recycled air inlet coupled to the channel, for recycling a portion of air from the interior of the versatile mill into the versatile mill, a separating annulus for separating air flow from recycled air flow into the versatile mill; and a material inlet tube for admitting material into the versatile mill to be milled.

2. The versatile mill of claim 1, further comprising:

a cover disk, coupled to and turning with the milling shaft, said cover disk being located beneath the milling compartment such that matter from the milling compartment falling onto the cover disk is carried away by centrifugal force of the cover disk.

3. A versatile mill, comprising:

a driving motor;

a milling portion, linked to the driving motor by a belt drive; and a support, coupled to the driving motor and the milling portion, for allowing simultaneous telescopic adjustment of the height of the combination of the milling portion and the driving motor wherein the milling portion further comprises:

an inner wall;

an outer casing;

a channel formed between the inner wall and the outer coat and;

an air inlet connected to the channel;

a fan installed in the air inlet such that air flows from the air inlet, through the channel and past bearings on a milling shaft of the milling portion, a bottom portion of a milling compartment formed in the milling portion, inner walls of the milling compartment to cooling slits and to a collector with discharge outlet slits, wherein said versatile mill further comprises:

a recycled air inlet coupled to the channel, for recycling a portion of air from the interior of the versatile mill into the versatile mill, a separating annulus for separating air flow from recycled air flow into the versatile mill;

a material inlet tube for admitting material into the versatile mill to be milled;

knives mounted in combination with intermediate discs and spacer washers on the milling shaft in the milling chamber, wherein said knives are freely rotatable on the milling shaft until engaged by means of a cylindrical safety pin or other connecting device, and the intermediate discs are provided with holes shaped so as to fit a profile of the milling shaft.

4. A versatile mill comprising:

a milling chamber for receiving material to be milled;

a milling shaft, passing through at least a portion of the milling chamber;

at least one disc, mounted to milling shaft by a hole having the profile of the milling shaft;

at least one knife having a hole for rotatably accepting the milling shaft, said at least one knife coupled to the milling shaft by the at least one disc on the milling shaft in the milling chamber, wherein said knives are freely rotatable on the milling shaft until engaged to the at least one disc by means of a pin.

5. The versatile mill of claim 4, further comprising:

holes formed in the at least one disc in the same position and of the same shape as corresponding holes formed in the at least one knife for receiving the pin after positioning of the at least one knife.

6. The versatile mill of claim 5, wherein the at least one knife has a flat body on which pins are fitted on both sides alternatively in two rows, each pin comprising two cylindrical parts of different thickness.

7. The versatile mill of claim 5, wherein at least one of the at least one knife has its flat body fitted alternatively on one side with flat angular forms.

8. The versatile mill of claim 5, wherein at least one of the at least one knife has its flat body fitted at each front side with alternatively upwardly and downwardly bent beams.

9. The versatile mill of claim 5, wherein at least one of the at least one knife further comprises:

a flat body having an acute-angled front; and flat attachments fitted, at various distances from an end in the direction of knife rotation on an upper or lower side, the flat attachments having sides end up in an acute angle in the direction of knife rotation.

10. The versatile mill of claim 5, wherein at least one of the at least one knife further comprises:

a flat body having an acute-angled front portion, and an attachment, fitted at approximately a middle portion of the acute-angled front, the attachment bent more or less upwards with its front being turned in the same direction as the acute-angled front of the flat body.

11. The versatile mill of claim 5, wherein at least one of the at least one knife further comprises:

a flat body having an acute-angled front portion, and an attachment, fitted at approximately a middle portion of the acute-angled front, the attachment bent more or less upwards with its front being turned in the opposite direction from the acute-angled front of the flat body.

12. The versatile mill of claim 5, wherein the at least one knife further comprises:

a plurality of knives of various shapes, at least a portion of which are clamped on the milling shaft, with the at least one disc and spacers between a sleeve and a nut.

13. The versatile mill of claim 12, wherein the nut is shaped to enhance a distribution of material to be ground to outer perimeter parts of the milling compartment.

14. The versatile mill of claim 4, wherein the at least one knife have a flat body on which pins are fitted on both sides alternatively in two rows, each pin comprising two cylindrical parts of different thickness.

15. The versatile mill of claim 4, wherein at least one of the at least one knife has its flat body fitted alternatively on one side with flat angular forms.

16. The versatile mill of claim 4, wherein at least one of the the at least one knife has its flat body fitted at each front side with alternatively upwardly and downwardly bent beams.

17. The versatile mill of claim 4, wherein at least one of the at least one knife further comprises:

a flat body having an acute-angled front; and flat attachments fitted, at various distances from an end in the direction of knife rotation on an upper or lower side, the flat attachments having sides end up in an acute angle in the direction of rotation of the knife.

18. The versatile mill of claim 4, wherein at least one of the at least one knife further comprises:

a flat body having an acute-angled front portion, and an attachment, fitted at approximately a middle portion of the acute-angled front, the attachment bent more or less upwards with its front being turned in the same direction as the acute-angled front of the flat body.

19. The versatile mill of claim 4, wherein at least one of the at least one knife further comprises:

a flat body having an acute-angled front portion, and an attachment, fitted at approximately a middle portion of the acute-angled front, the attachment bent more or less upwards with its front being turned in the opposite direction from the acute-angled front of the flat body.

20. The versatile mill of claim 4, wherein the at least one knife further comprises:

a plurality of knives of various shapes, at least a portion of which are clamped on the milling shaft, with the at least one disc and spacers between a sleeve and a nut.

21. The versatile mill of claim 20, wherein the nut is shaped to enhance a distribution of material to be ground to outer perimeter parts of the milling compartment.

22. The versatile mill of claim 4, further comprising:

wherein said pin positions the at least one knife relative to the disc at a predetermined angle.

23. The versatile mill of claim 22, wherein said disc is provided with a plurality of holes, said at least one knife comprises a plurality of knives which may be positioned with corresponding pins and the plurality of holes, at predetermined angles to each other and relative to the disc.

* * * * *